US010662618B2

(12) United States Patent
Kaneta et al.

(10) Patent No.: US 10,662,618 B2
(45) Date of Patent: May 26, 2020

(54) CONSTRUCTION MACHINE

(71) Applicant: Hitachi Construction Machinery Co., Ltd., Taito-ku, Tokyo (JP)

(72) Inventors: Tomoaki Kaneta, Ibaraki (JP); Akihiro Narazaki, Ibaraki (JP); Katsuaki Kodaka, Ibaraki (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 0 days.

(21) Appl. No.: 16/328,902

(22) PCT Filed: Feb. 21, 2018

(86) PCT No.: PCT/JP2018/006200
§ 371 (c)(1),
(2) Date: Feb. 27, 2019

(87) PCT Pub. No.: WO2018/163821
PCT Pub. Date: Sep. 13, 2018

(65) Prior Publication Data

US 2019/0211530 A1 Jul. 11, 2019

(30) Foreign Application Priority Data

Mar. 6, 2017 (JP) ..... 2017-042100

(51) Int. Cl.
*E02F 9/22* (2006.01)
*E02F 9/20* (2006.01)
*E02F 5/02* (2006.01)

(52) U.S. Cl.
CPC ..... *E02F 9/2221* (2013.01); *E02F 5/02* (2013.01); *E02F 9/2041* (2013.01); *E02F 9/22* (2013.01); *E02F 9/2271* (2013.01)

(58) Field of Classification Search
CPC ..... E02F 9/2221; E02F 9/2235; E02F 9/2296; E02F 9/264
See application file for complete search history.

(56) References Cited

U.S. PATENT DOCUMENTS 8,972,122 B2 * 3/2015 Magaki ..... E02F 9/2214 701/50
9,382,687 B2 * 7/2016 Tsukamoto ..... E02F 9/265
(Continued)

FOREIGN PATENT DOCUMENTS

JP 5-17972 A 1/1993
JP 3767874 B2 4/2006
(Continued)

OTHER PUBLICATIONS

International Search Report (PCT/ISA/210) issued in PCT Application No. PCT/JP2018/006200 dated Apr. 3, 2018 with English translation (four (4) pages).
(Continued)

*Primary Examiner* — Thomas E Lazo
(74) *Attorney, Agent, or Firm* — Crowell & Moring LLP

(57) ABSTRACT

To prevent increase/decrease in pump flow rate due to load variation with change in the posture of a work attachment and improve the operability in arm pushing operation. A hydraulic excavator 1 with a front mechanism including an arm 33 driven by a hydraulic actuator 43 through operation of an operating lever 50 includes: first and second angle sensors 37 and 38 which detect the posture of the arm 33; and a controller 49 which, when the posture of the arm 33 is at a remoter side from an upperstructure 20 than a preset position and the position of a bucket 35 is adjusted from a maximum or nearly maximum preset operation amount of the operating lever 50 in arm pushing operation by the operating lever 50, changes the flow rate characteristic of pressure oil in relation to discharge pressure of a hydraulic
(Continued)

pump 41 for supplying pressure oil to the hydraulic actuator 43, to characteristic PTS with a higher flow rate than flow rate characteristic PT at the time of operation with an operation amount other than the above operation amount, to drive the hydraulic pump 41.

4 Claims, 11 Drawing Sheets

(56) References Cited

U.S. PATENT DOCUMENTS 9,518,370 B2 * 12/2016 Tsukamoto ..... E02F 3/435
9,598,845 B2 * 3/2017 Baba ..... E02F 9/2033

FOREIGN PATENT DOCUMENTS

JP 2015-183756 A 10/2015
WO WO 2016/104016 A1 6/2016

OTHER PUBLICATIONS

Japanese-language Written Opinion (PCT/ISA/237) issued in PCT Application No. PCT/JP2018/006200 dated Apr. 3, 2018 (there (3) pages).

* cited by examiner

CONSTRUCTION MACHINE

TECHNICAL FIELD

The present invention relates to a construction machine which performs work with a work attachment.

BACKGROUND ART

As a technique of this kind, for example, the technique described in Japanese Patent No. 3767874 (PATENT LITERATURE 1) is known. This technique concerns a hydraulic excavator with a work attachment connected to an upperstructure, characterized by including a work attachment posture detecting means, work attachment operating means, calculating means to receive a posture detection signal from the work attachment posture detecting means and an operation signal from the work attachment operating means, and control means to control the moving speed of the work attachment according to an output signal from the calculating means, in which the calculating means sends the output signal to make the moving speed of the work attachment corresponding to the operation signal lower when the posture detection signal indicates a larger distance between a given position of the work attachment and the upperstructure.

CITATION LIST

Patent Literature

PATENT LITERATURE 1: Japanese Patent No. 3767874

SUMMARY OF INVENTION

Technical Problem

A hydraulic excavator as a kind of construction machine includes an arm and a boom as front mechanisms. For the arm, the load varies largely even during aerial movement, depending on the angle of the arm. Even with the same lever operation, the pump flow rate increases or decreases with load variation due to change in the posture of the work attachment attached to the tip of the arm. For this reason, there is a tendency that unintended speed change occurs, resulting in behavior which is different from the operator's image of operation.

Particularly when a heavy attachment is attached, at the time of positioning the attachment tip by arm pushing operation in aerial movement with the arm at a remoter side than the upperstructure, the load pressure increases and thereby the pump flow rate decreases. In addition to this, operation to stop the front mechanism, namely the lever operation amount itself also decreases and thus the amount of decrease in the front speed may not match the operator's image of operation.

PATENT LITERATURE 1 makes boom raising operation and arm pulling operation easy by decreasing the arm pulling speed when the work attachment is at a remoter side than the upperstructure. This technique can contribute to improvement in the operability in raising the boom and pulling the arm when the arm speed changes depending on the posture of the work attachment.

However, PATENT LITERATURE 1 does not mention the operability for stop at a desired position in arm pushing operation during aerial movement and does not solve the problem about the operability in arm pushing operation that even with the same lever operation the pump flow rate increases or decreases with load variation due to change in the posture of the work attachment, which may result in behavior different from the operator's image of operation.

Therefore, the problem which the present invention intends to solve is to prevent the increase/decrease in pump flow rate due to load variation with change in the posture of the work attachment and improve the operability in arm pushing operation.

Solution to Problem

In order to solve the above problem, according to one aspect of the present invention, there is provided a construction machine characterized by including: an engine; a hydraulic pump driven by the engine; an arm cylinder driven by pressure oil discharged from the hydraulic pump; an arm operated by extension and shrinkage of the arm cylinder; a front mechanism including the arm and a work attachment attached to the tip of the arm; an operating device for operating the arm; and a control device for controlling a flow rate of the hydraulic pump based on an operation amount of operation by the operating device, in which the construction machine includes a posture sensor for detecting the posture of the arm and an operation amount sensor for detecting the operation amount of the operating device, and in case that the control device decides that the posture of the arm detected by the posture sensor has changed to a posture in a remoter position from the main body of the construction machine than a vertical position with respect to a ground, and that the operation amount detected by the operation amount sensor has changed from a maximum or nearly maximum preset operation amount to an operation amount toward a fine manipulation direction for positioning of the work attachment, the control device changes a flow rate characteristic of pressure oil in relation to discharge pressure of the hydraulic pump to a characteristic with a higher flow rate than a flow rate characteristic at time of operation with an operation amount other than the operation amount detected by the operation amount sensor, to drive the hydraulic pump.

Advantageous Effects of Invention

According to one aspect of the present invention, the increase/decrease in pump flow rate due to load variation with change in the posture of the work attachment is prevented and the operability in arm pushing operation can be improved. Other and further objects, features, and advantages will appear more fully from the following description of an embodiment.

DESCRIPTION OF EMBODIMENTS

Next, an embodiment of the present invention will be described by taking examples, referring to drawings.

Example 1

Figure 1:
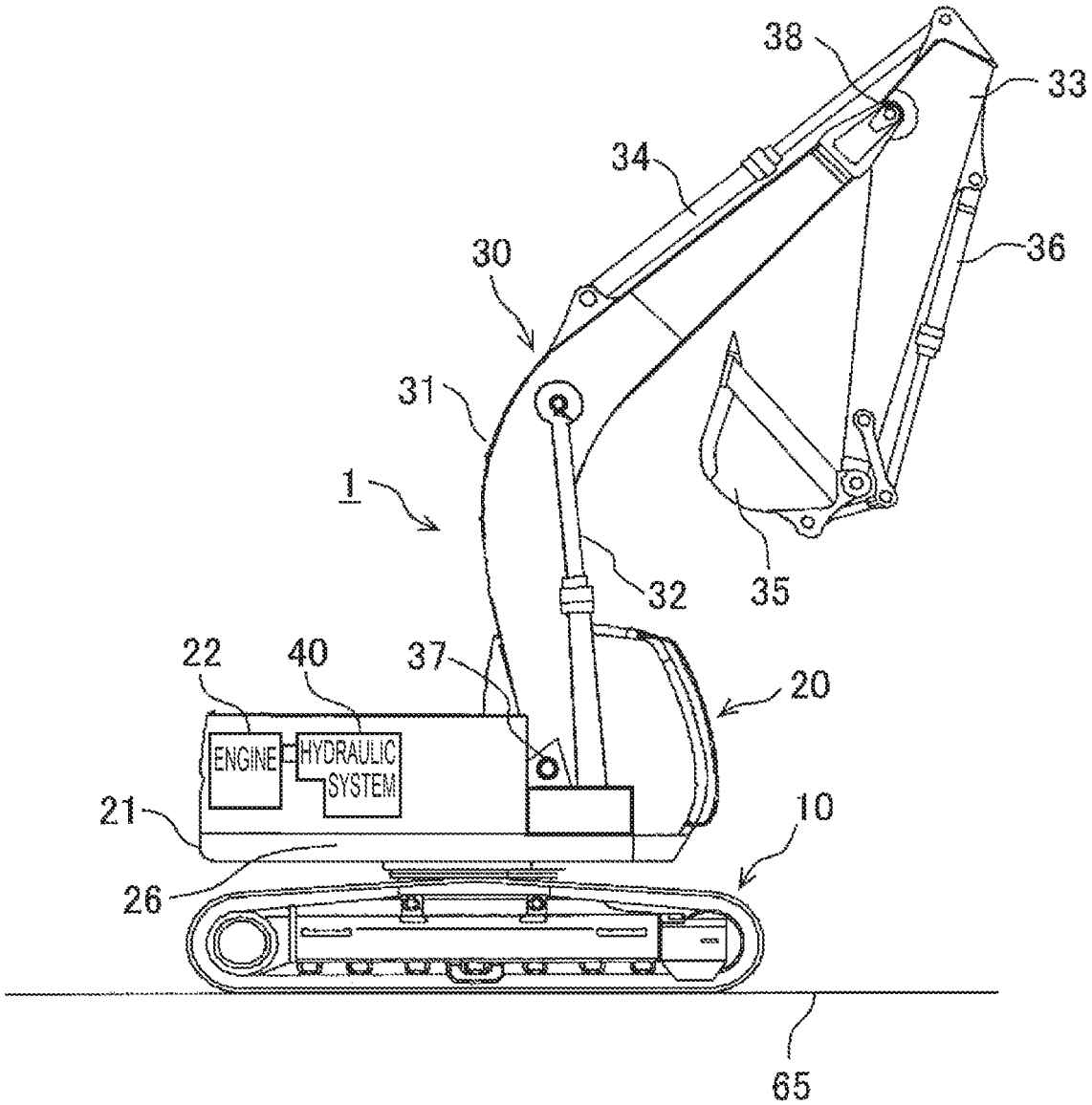
FIG. 1 is a side view which shows the general structure of a hydraulic excavator according to Example 1 in an embodiment of the present invention.
Figure 2:
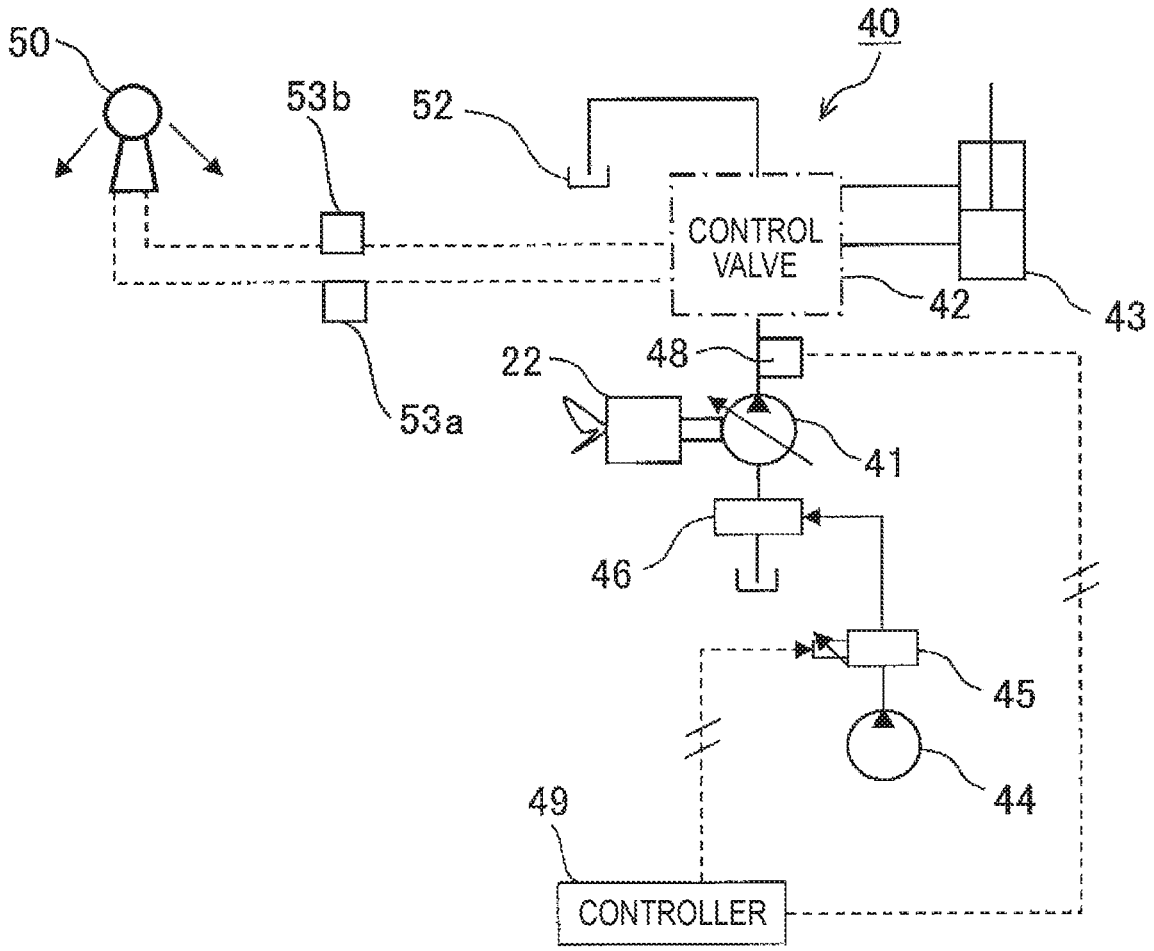
FIG. 2 is a block diagram which shows the system configuration of the hydraulic apparatus of the hydraulic excavator according to Example 1.

FIG. 1 is a side view which shows the general structure of a hydraulic excavator as a construction machine according to Example 1 in the embodiment of the present invention, and FIG. 2 is a block diagram which shows the system configuration of the hydraulic apparatus of the hydraulic excavator according to Example 1. In this example, a hydraulic excavator is taken for example but the present invention can be applied to construction machinery in general (including working machineries) and the present invention is not limited to hydraulic excavators. For example, the present invention can be applied to other construction machineries with a work arm, such as crane vehicles.

In FIG. 1, the hydraulic excavator 1 includes an undercarriage 10, an upperstructure 20 swingably provided over the undercarriage 10, and an excavator mechanism 30 mounted on the upperstructure 20 or so-called front device.

The excavator mechanism 30 includes a boom 31, boom cylinder 32, arm 33, arm cylinder 34, bucket 35, and bucket cylinder 36. The boom cylinder 32 is a hydraulic actuator 43 for driving the boom 31. The arm 33 is pivotally supported in the vicinity of the tip part of the boom 31 in a rotatable manner and driven by the arm cylinder 34. The bucket 35 is pivotally supported on the tip of the arm in a rotatable manner and driven by the bucket cylinder 36. A first angle sensor 37 which detects the angle of the boom 31 with respect to the upperstructure 20 is provided at the connection between the boom 31 and upperstructure 20 and a second angle sensor 38 which detects the angle of the arm 33 with respect to the boom 31 is mounted on the connection between the boom 31 and arm 33.

A hydraulic system 40 for driving the hydraulic actuators 43 such as the boom cylinder 32, arm cylinder 34, and bucket cylinder 36 is mounted over a swing frame 21 of the upperstructure 20. The hydraulic system 40 includes a hydraulic pump 41 as an oil pressure source which generates oil pressure (FIG. 2), and a control valve 42 for controlling the drive of the boom cylinder 32, arm cylinder 34, and bucket cylinder 36 (FIG. 2), and the hydraulic pump 41 is driven by an engine 22.

In FIG. 2, the hydraulic system 40 in this example includes a hydraulic pump 41, control valve 42, hydraulic actuator 43, pilot pump 44, pump torque control solenoid valve 45, pump regulator 46, pump discharge pressure sensor 48, controller 49, operating lever 50, hydraulic oil tank 52, and first and second pressure sensors 53*a* and 53*b*.

The operating lever 50 generates an oil pressure pilot signal depending on operation input of the operating lever 50. This oil pressure pilot signal is sent to the control valve 42 to switch the flow rate/directional control valve inside the control valve 42 and supply discharged oil from the hydraulic pump 41 to the hydraulic actuator 43 to drive the hydraulic actuator 43. In addition, the lever operation amount of the operating lever 50 is detected according to pressures of the first and second pressure sensors 53*a* and 53*b* (operation amount sensors) which send an oil pressure pilot signal. Also, the pump discharge pressure sensor 48 is installed in the hydraulic conduit on the discharge side of the hydraulic pump 41 and the pump discharge pressure detected by the pump discharge pressure sensor 48 is sent to the controller 49. The controller 49 drives the pump torque control solenoid valve 45 according to the lever operation amount detected by the first and second pressure sensors 53*a* and 53*b* and the pump discharge pressure detected by the pump discharge pressure sensor 48, and controls the pilot pressure from the pilot pump 44 to control the discharge flow rate of the hydraulic pump 41 through the pump regulator 46.

The controller 49 is a microcomputer system which includes a CPU (Central Processing Unit), ROM (Read Only Memory), and RAM (Random Access Memory). The CPU includes a control section and a calculating section, in which the control section interprets commands and controls the control sequence of the program and the calculating section performs calculations. In addition, the program is stored in the ROM and a command which should be executed (a numerical value or a series of numerical values) is taken out of the ROM where the program is placed and expanded on the RAM to execute the program. The controller 49 electrically controls the entire hydraulic excavator 1 and various sections.

Although one hydraulic actuator 43 is shown in FIG. 2, it corresponds to each of at least the boom cylinder 32, arm cylinder 34, and bucket cylinder 36 in FIG. 1. However, since this example concerns arm pushing operation, an explanation will be given on the assumption that the hydraulic actuator 43 shown in FIG. 2 corresponds to the arm cylinder 34.

Figure 3:
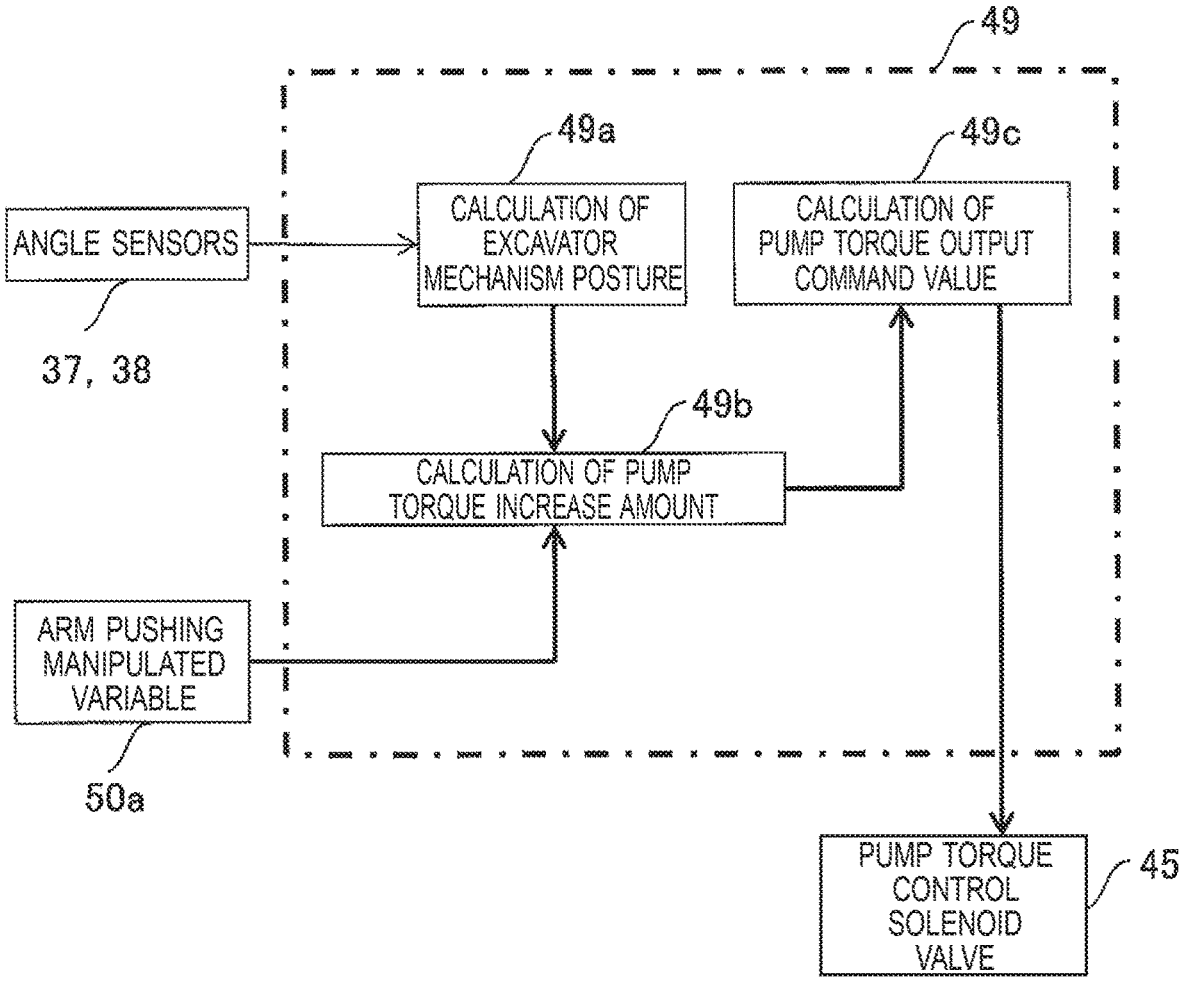
FIG. 3 is a block diagram which explains how pump torque increase control is performed by the controller in FIG. 2.

FIG. 3 is a block diagram which explains how pump torque increase control is performed by the controller 49 in FIG. 2. The controller 49 includes an excavator mechanism posture calculating section 49*a*, pump torque increase amount calculating section 49*b*, and pump torque output command value calculating section 49*c*. These calculating sections 49*a*, 49*b*, and 49*c* are implemented as software to perform the above various calculating functions on the program, not as hardware. However, each of these sections can be implemented as hardware, for example, by an ASIC (Application Specific Integrated Circuit).

The excavator mechanism posture calculating section 49*a* receives the angle signal for the boom 31 and the angle signal for the arm 33 from the first and second angle sensors 37 and 38. The excavator mechanism posture calculating section 49*a* calculates the posture of the excavator mechanism 30 from the angle signals received from the first and second angle sensors 37 and 38. During arm pushing operation to move the arm 33 toward the remote side (forward) by aerial movement, the posture of the excavator mechanism 30 as calculated by the excavator mechanism posture calculating section 49*a*, here the vertical position of the arm 33 with respect to the ground 65, is detected and when the arm 33 is at a remoter (forward) side from the vehicle body than this position, flow rate increase control in this example is performed. The vertical position with respect to the ground 65 will be described later and shown by sign A in FIG. 6.

Specifically, the pump torque increase amount calculating section 49*b* of the controller 49 receives a lever operation amount signal as an arm pushing operation amount 50*a* detected according to the first and second pressure sensors 53*a* and 53*b*. The pump torque increase amount calculating section 49*b* determines the amount of pump torque increase in relation to the lever operation amount from the calculated posture of the excavator mechanism 30 and the arm pushing operation amount 50*a* and sends a calculated pump torque increase amount signal to the pump torque output command value calculating section 49*c*. The pump torque output command value calculating section 49*c* sends a control signal appropriate to the increase in flow rate as determined according to the P-Q equivalent horsepower curve shown in FIG. 7 to the pump torque control solenoid valve 45, which will be described later. Consequently, when the operating lever 50 is manipulated toward the arm pushing direction in order to stop the arm 33 or work attachment at a desired position, the increased flow rate is supplied to the hydraulic actuator 43, thereby suppressing the decline in the moving speed of the arm 33 toward the arm pushing operation direction.

The reason that the arm pushing operation speed in relation to lever manipulation is increased when stopping the arm 33 or work attachment at the desired position is as follows: for example, when trying to move the arm 33 from the position indicated by sign A in FIG. 6 further toward the arm pushing operation direction, the force to resist the weight including the work attachment attached to the tip of the arm 33, or the bucket 35 in the figure, is required and accordingly the load becomes larger, so if the flow rate is the same as in arm pushing operation at a nearer side than the position indicated by sign A, the speed would decrease. On the other hand, when retracting the arm from the arm pushing operation direction, due to the own weight, the force of gravity is applied toward the retracting direction and the load becomes smaller.

Figure 4:
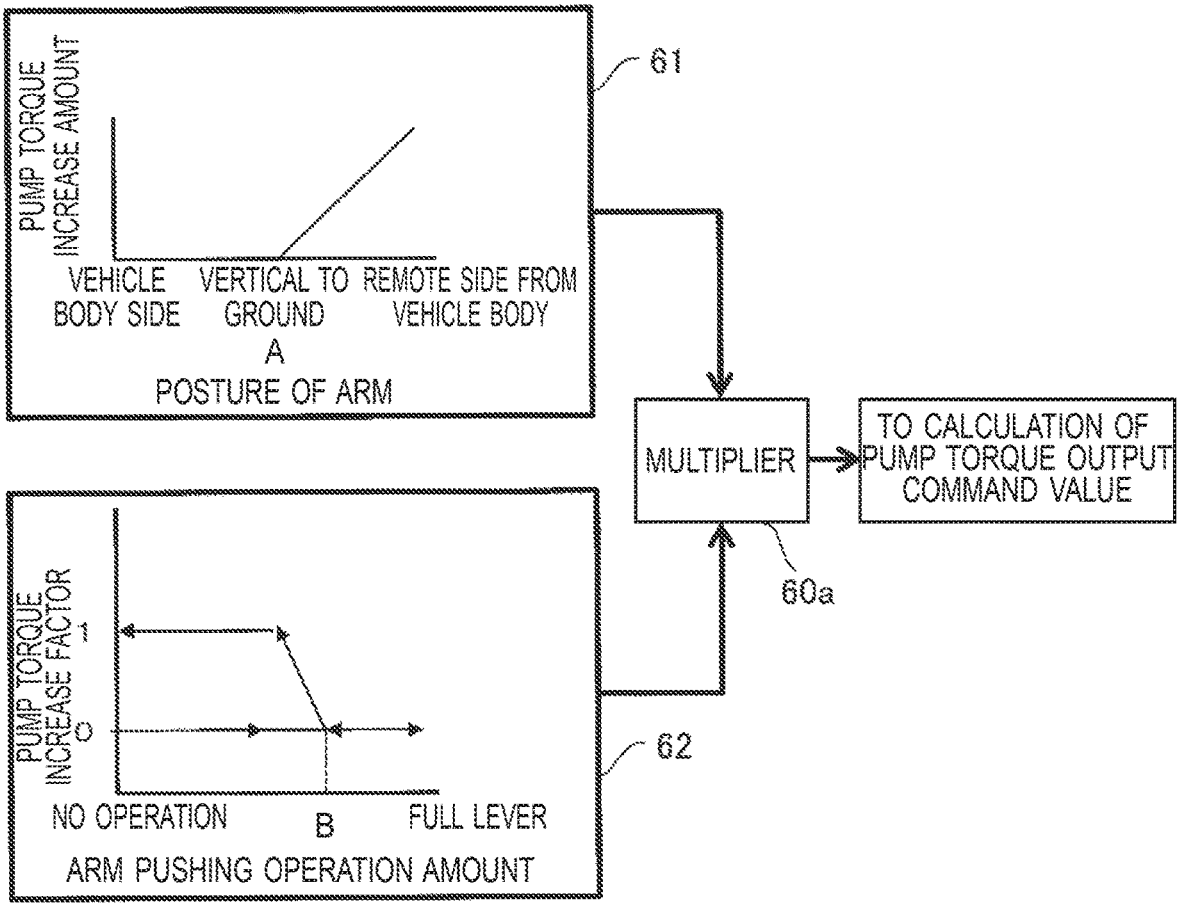
FIG. 4 is an explanatory diagram which shows the calculation method to send a signal indicating the pump torque increase amount, from the posture of the arm and the arm pushing operation amount.

FIG. 4 is an explanatory diagram which shows the calculation method to send a signal indicating the amount of pump torque increase as calculated from the posture of the arm 33 and the arm pushing operation amount 50*a* to the pump torque output command value calculating section 49*c*. As shown by a first characteristic 61 which indicates the relation between the posture of the arm 33 and the amount of pump torque increase in the figure, the reference position for the posture of the arm 33 is the vertical position with respect to the ground 65 (A position) and the pump torque increases linearly from the A position until the arm pushing operation amount 50*a* reaches full lever. On the other hand, when manipulating the operating lever 50 from the no-operation position to the full lever position, the pump torque increase factor is 0. When trying to stop at the desired position by arm pushing operation, the operating lever 50 is slightly retracted from the full lever position to decrease the speed; at this time, the speed decreases due to the own weight as mentioned above and this lever retracting manipulation causes the arm 33 to stop before it reaches the target position.

For this reason, in this example, at the time when the operating lever 50 is slightly retracted from full lever manipulation and the pilot pressure goes down, for example, to PB as shown in FIG. 4, the pump torque increase amount is multiplied by a pump torque increase factor by a multiplier 60*a* and the product (value) is sent as a pump torque corrected increase amount to the pump torque output command value calculating section 49*c*. As can be understood from the first characteristic 61 in FIG. 4, the pump torque increase factor increases linearly from the pilot pressure PB and stops increasing at the A position where the arm 33 is vertical to the ground 65. The factor at the moment of stop, here "1", is used for multiplication.

The second characteristic 62 which shows the relation between the arm pushing operation amount 50*a* and pump torque increase factor in FIG. 4 is one example. Therefore, a plurality of characteristics depending on the characteristics of the hydraulic circuit or the bottom chamber pressure of the boom 31 are prepared in the form of tables and stored in the storage of the controller 49 so that at the time of calculating the pump torque increase amount, the CPU selects an appropriate characteristic table from among the tables and performs a calculation in reference to the selected table.

Figure 5:
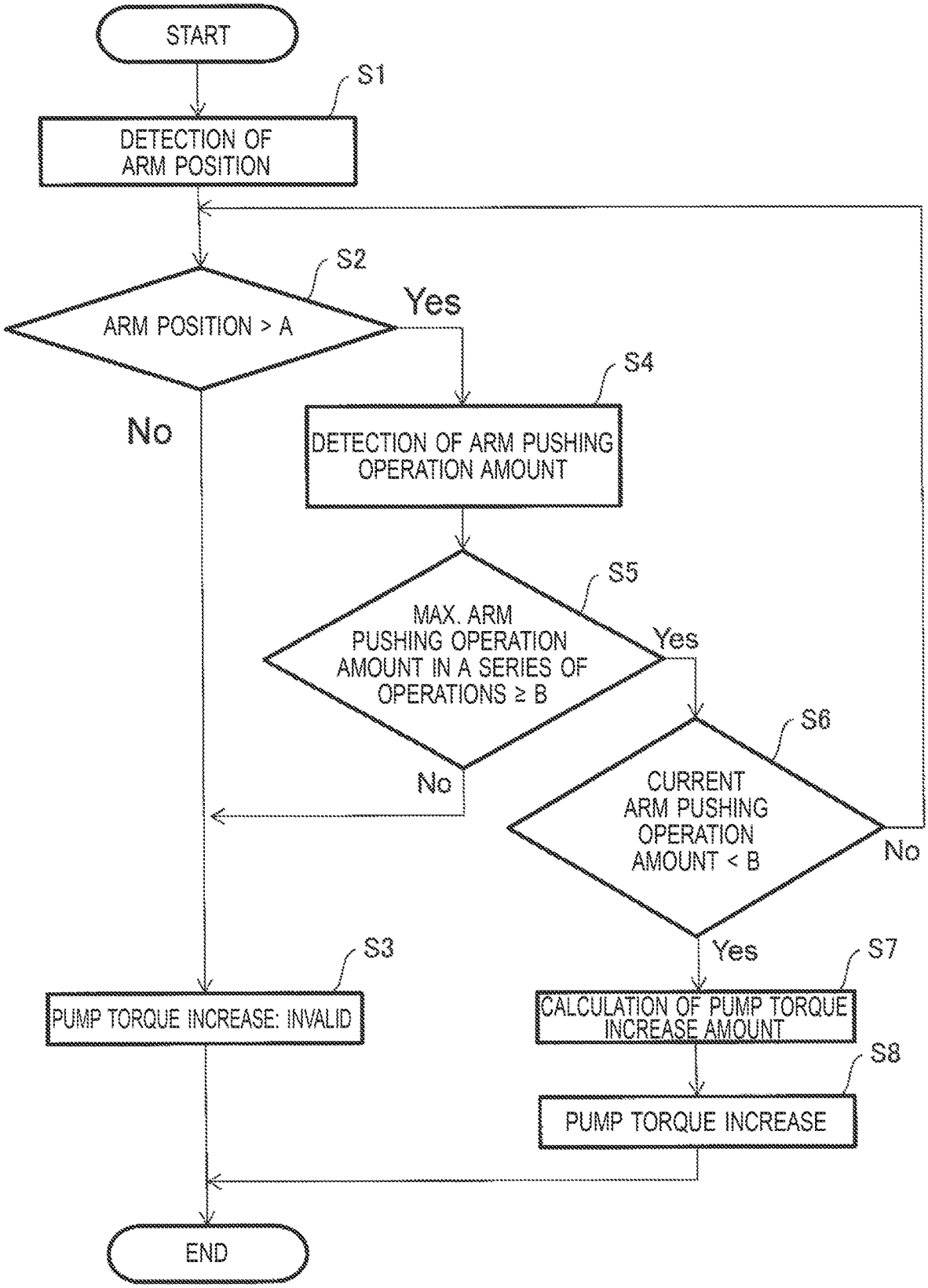
FIG. 5 is a flowchart which shows the control sequence for pump torque increase control which is performed by the controller.

FIG. 5 is a flowchart which shows the control sequence for pump torque increase control which is performed by the controller 49. In this control sequence, first, the position of the arm 33 is detected according to the angles detected by the first and second angle sensors 37 and 38 (Step S1). Then, a decision is made as to whether or not the position of the arm 33 is at a remoter (forward) side from the vehicle body than the A position vertical to the ground 65 (Step S2). If here it is decided that the position of the arm 33 is at a nearer side (upperstructure 20 side) to the vehicle body than the A position, it is unnecessary to increase the pump torque, so pump torque increase is made invalid (Step S3) to quit this processing sequence.

On the other hand, if it is decided at Step S2 that the position of the arm 33 is at a remoter side from the vehicle body than the A position (Step S2: Yes), the arm pushing operation amount 50*a* is detected (Step S4). Then, comparison is made between the maximum arm pushing operation amount in a series of operations and the operation amount B corresponding to the pilot pressure PB (Step S5). The operation amount B is a preset threshold to start pump torque increase control. In this comparison, if the maximum arm pushing operation amount is not less than the preset operation amount B (Step S5: No), pump torque increase is made invalid (Step S3), as can be understood from the second characteristic 62, to quit this processing sequence.

On the other hand, if the maximum arm pushing operation amount is less than the preset operation amount B (Step S5: Yes), comparison is made between the current arm pushing operation amount and the preset operation amount B (Step S6). Then, at the time when the current arm pushing operation amount becomes less than the preset operation amount B, namely when it is decided that the arm pushing operation amount 50*a* detected at Step S4 has changed from the maximum or nearly maximum preset operation amount B to the operation amount toward the fine manipulation direction for positioning of the bucket 35 (Step S6: Yes), the pump torque increase amount is calculated (Step S7) and according to the calculation result, a command is sent to the pump torque control solenoid valve 45 to increase the pump torque (Step S8) and then quit this control sequence.

Figure 6:
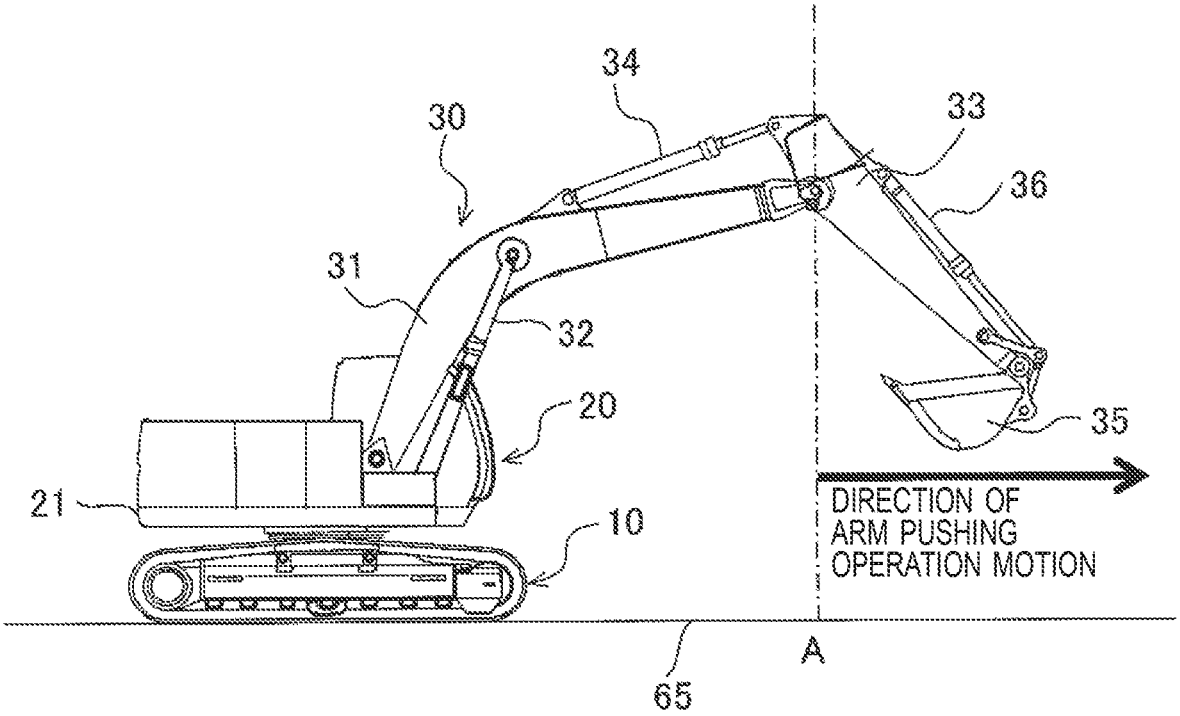
FIG. 6 is a view which shows arm pushing operation motion in aerial movement of the boom.
Figure 7:
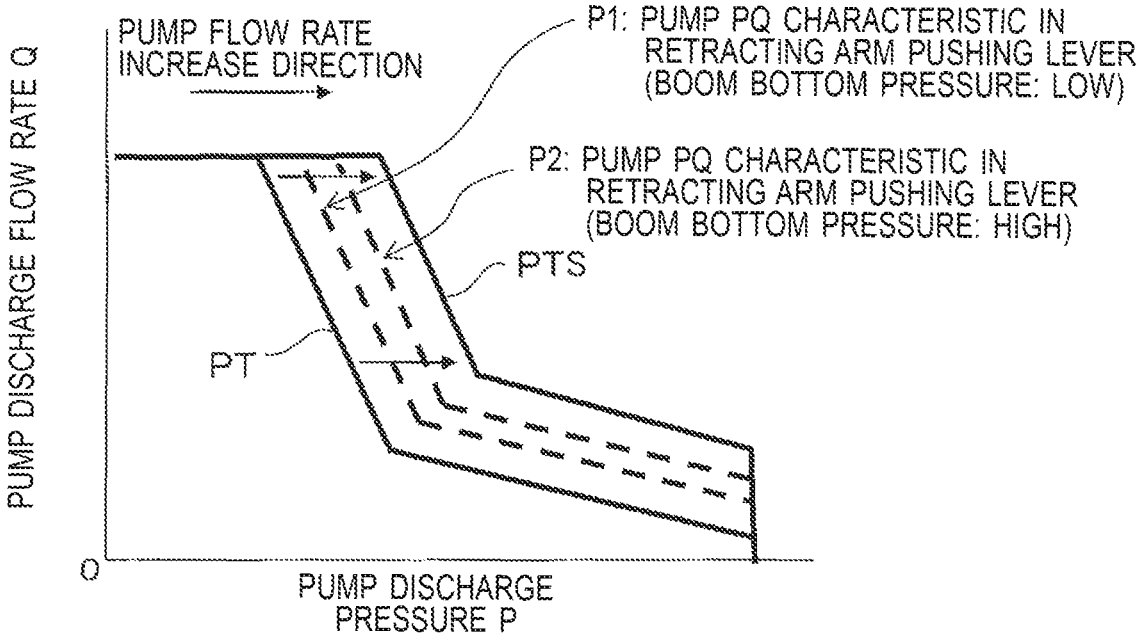
FIG. 7 is a characteristic graph which shows a P-Q equivalent horsepower curve in Example 1.

By performing control in this way, in the case of arm pushing operation with the posture of the arm 33 moving from the vertical position toward the remote side from the vehicle body as shown in FIG. 6, the P-Q equivalent horsepower curve shown in FIG. 7 is shifted toward the direction in which the flow rate is higher than in normal control (PT→PTS). Consequently, the arm pushing speed in relation to lever manipulation can be increased and when the operating lever 50 is retracted, the speed does not decrease too much and operation can be achieved as imagined by the operator. FIG. 6 is a view which shows arm pushing operation motion in aerial movement of the boom 31. The P-Q equivalent horsepower curve in FIG. 7 is controlled in normal operation according to the characteristic which allows latitude in increasing the flow rate. In FIG. 7, P represents pump discharge pressure and Q represents pump discharge flow rate. The characteristic in FIG. 7 shows a characteristic which allows the pump discharge flow rate to increase within the horsepower control range so that the achievable flow rate at the same pressure can be increased. In addition, P1 indicates the P-Q characteristic of the pump at the time of retracting the arm pushing operating lever with the boom bottom pressure low and P2 indicates the P-Q characteristic of the pump at the time of retracting the arm pushing operating lever with the boom bottom pressure high. P1 and P2 are examples of pump torque increase control in consideration of boom bottom pressure in Example 3 which will be described later.

In the case of arm pushing operation with the posture of the arm 33 moving from the vertical position toward the remote side from the vehicle body, the pump torque output command value calculating section 49*c* shifts the P-Q equivalent horsepower curve shown in FIG. 7 toward the direction in which the flow rate is higher than in normal control (arrow direction). Consequently, the hydraulic pump 41 can be driven with a high flow rate characteristic and the arm pushing speed in relation to lever manipulation can be increased and when the operating lever 50 is retracted, the speed does not decrease too much and operation can be achieved as imagined by the operator.

Example 2

Figure 8:
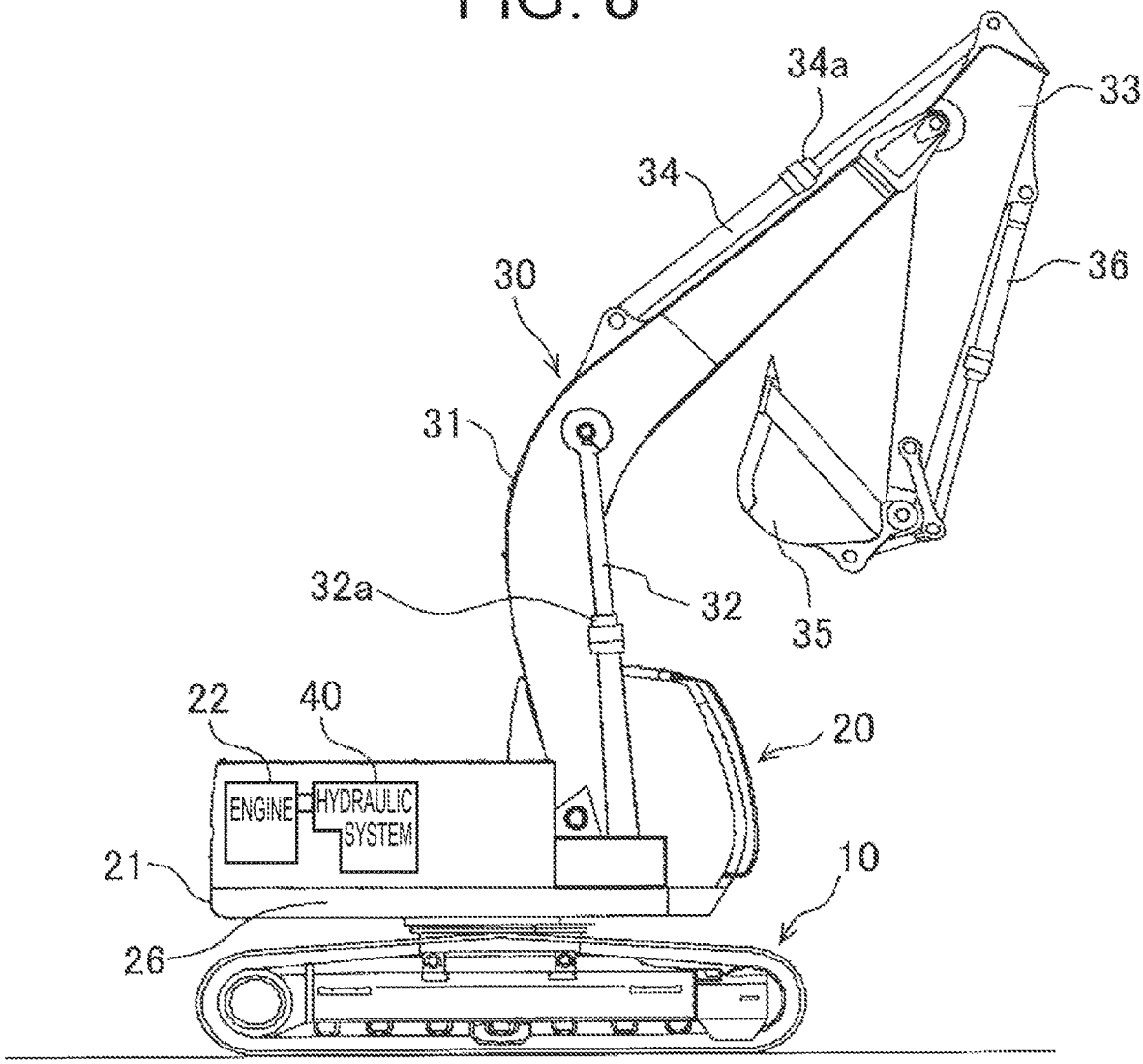
FIG. 8 is a side view which shows the general structure of a hydraulic excavator according to Example 2.

FIG. 8 is a side view which shows the general structure of the hydraulic excavator according to Example 2. In Example 2, the first and second angle sensors 37 and 38 in Example 1 are replaced by first and second stroke sensors and input signals to the excavator mechanism posture calculating section 49*a* in Example 1 are replaced by stroke detection signals from the first and second stroke sensors. The other elements are the same as in Example 1 and repeated description thereof is omitted and only the different elements are described below.

In FIG. 8, the boom cylinder 32 is provided with a boom stroke sensor 32*a* for detecting the moving amount (stroke) of the rod of the boom cylinder 32 and the arm cylinder 34 is provided with an arm stroke sensor 34*a* for detecting the moving amount (stroke) of the rod of the arm cylinder 34. For the boom stroke sensor 32*a* and arm stroke sensor 34*a*, a known distance sensor, for example, a ranging sensor which uses light, may be used. The other elements which are not described here are structured in the same way as in Example 1 and the same elements or elements which can be considered as identical are designated by the same reference signs and repeated description thereof is omitted.

Figure 9:
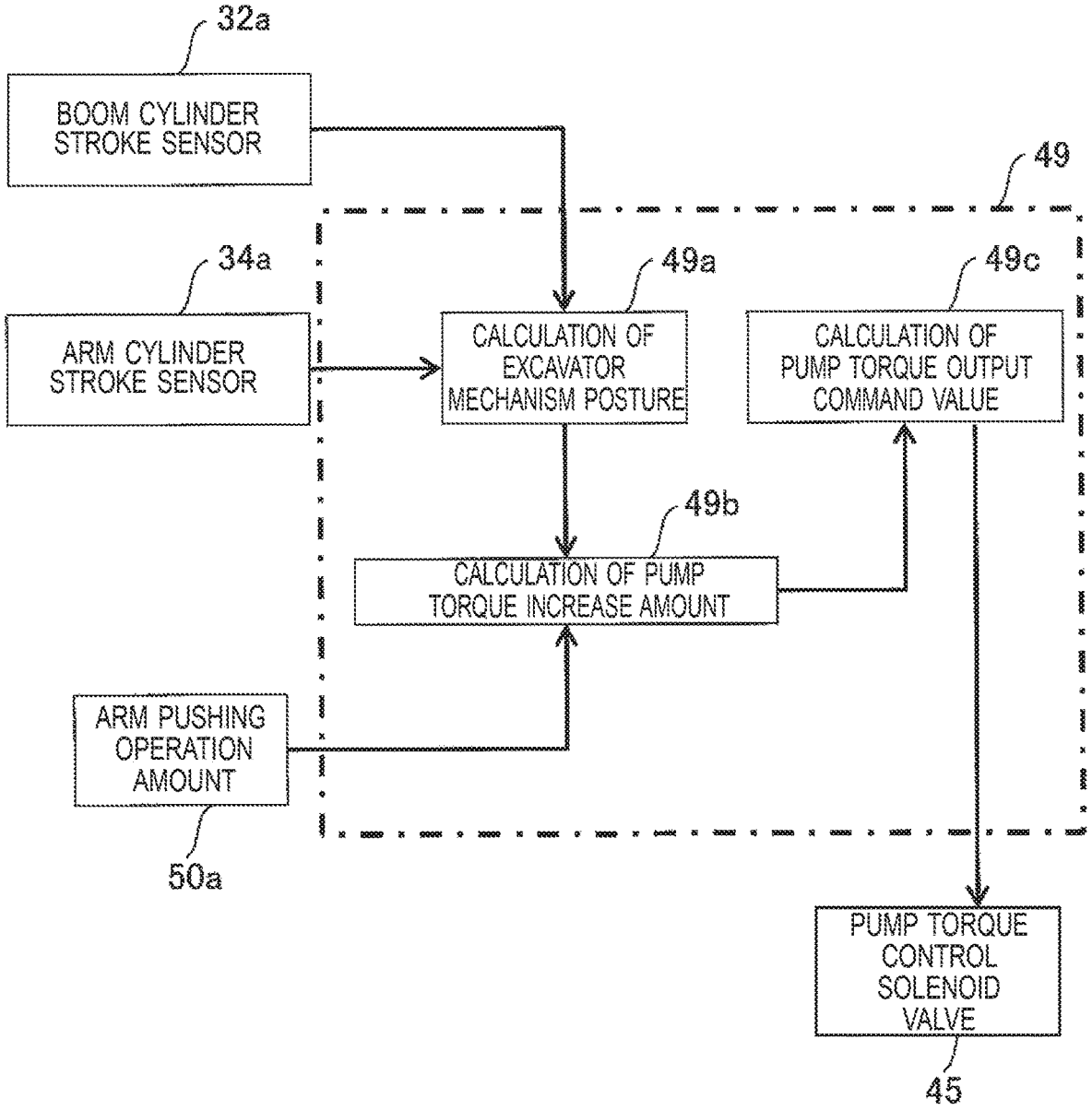
FIG. 9 is a block diagram which explains how pump torque increase control is performed by the controller according to Example 2.

FIG. 9 is a block diagram which explains how pump torque increase control is performed by the controller 49 according to Example 2. Example 2 is different from Example 1 only in that the first and second angle sensors 37 and 38 in Example 1 are replaced by the boom stroke sensor 32*a* and arm stroke sensor 34*a*, so instead of angle signals sent from the first and second angle sensors 37 and 38 to the excavator mechanism posture calculating section 49*a* in Example 1, stroke signals are sent from the boom stroke sensor 32*a* and arm stroke sensor 34*a* so that the excavator mechanism posture calculating section 49*a* calculates the posture of the excavator mechanism 30. The other control processes which are not described here are performed in the same way as in Example 1 and description thereof is omitted.

According to Example 2, since the position of the arm 33 can be detected from the calculated posture of the excavator, the pump torque increase amount can be calculated by the same procedure as in FIG. 4 in Example 1 and flow rate increase control can be performed in the same way as in Example 1.

Example 3

Figure 10:
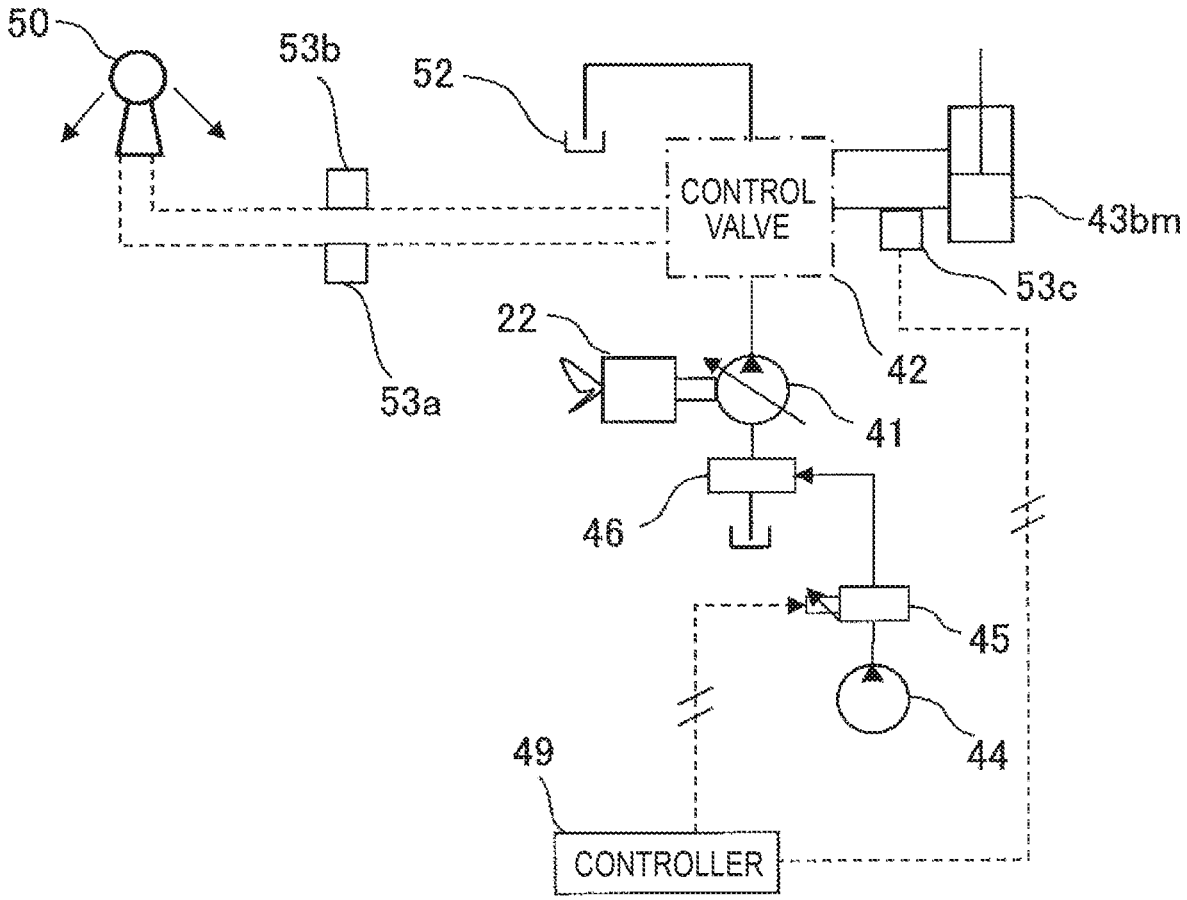
FIG. 10 is a block diagram which shows the system configuration of the hydraulic apparatus of a hydraulic excavator according to Example 3.

FIG. 10 is a block diagram which shows the system configuration of the hydraulic apparatus of the hydraulic excavator according to Example 3.

This example is different from Example 1 in that a third pressure sensor 53*c* is provided to detect the pressure of the bottom chamber of a hydraulic actuator 43*bm* corresponding to the boom cylinder 32 and the position of the boom 31 is detected from the pressure of the bottom chamber of the hydraulic actuator 43*bm* to calculate the pump torque increase amount and perform flow rate increase control. The other elements are the same as in Example 1 and the same elements or elements which can be considered as identical are designated by the same reference signs and repeated description thereof is omitted.

Figure 11:
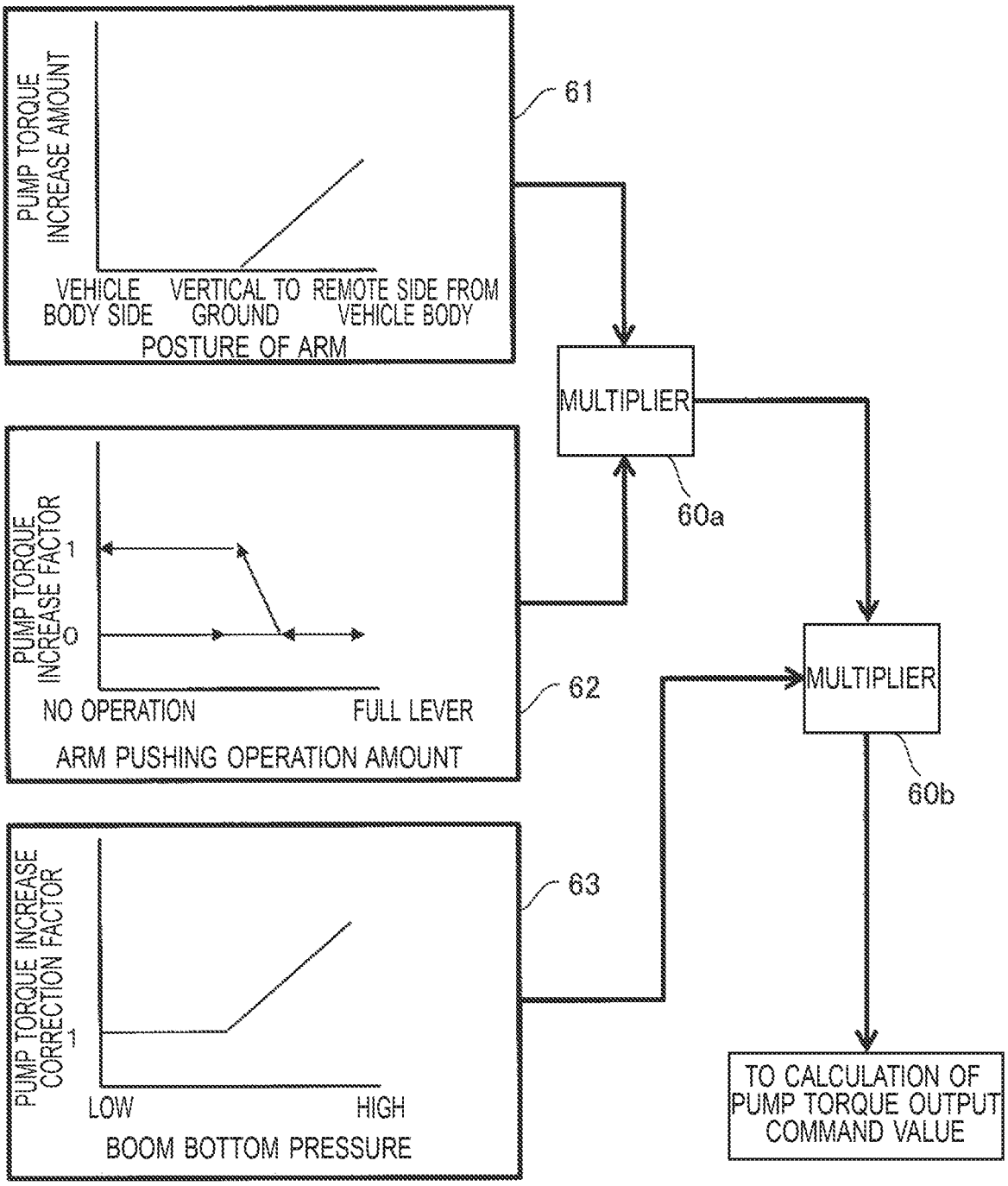
FIG. 11 is an explanatory diagram which shows the calculation method to send a signal indicating the pump torque increase amount, from the posture of the arm, the arm pushing operation amount, and the pressure of the bottom chamber of the boom cylinder.

FIG. 11 is an explanatory diagram which shows the calculation method to send a signal indicating the pump torque increase amount as calculated from the posture of the arm 33, the arm pushing operation amount 50*a*, and the pressure of the bottom chamber of the hydraulic actuator 43*bm* to the pump torque output command value calculating section 49*c*.

In Example 3, a command value is calculated in consideration of the boom bottom pressure in addition to the command value calculated by the calculation method in Example 1 as shown in FIG. 4. The boom bottom pressure varies depending on the position of the boom 31. As the arm 33 moves from the A position where the arm 33 is vertical to the ground 65, toward the remote side from the vehicle body, the pressure applied to the boom bottom chamber (reactive force to bear the weights of the boom 31 and arm 33) becomes larger and maximized when the arm 33 is extended maximally. On the other hand, even when the boom 31 moves from the A position toward the vehicle body, the boom bottom pressure does not change.

Therefore, in this example, when the boom bottom pressure is higher than a preset threshold, the pump torque increase amount is corrected. In FIG. 11, according to the characteristic shown as a third characteristic 63 which shows the relation between boom bottom pressure and pump torque increase correction factor, when the boom bottom pressure is higher than the boom bottom pressure corresponding to the A position, the pump torque output command value calculated from the characteristics in FIG. 4 is multiplied by a pump torque increase correction factor corresponding to that pressure, here a correction factor not less than 1, by a multiplier 60*b* and the product is sent as a pump torque output command value to the pump torque control solenoid valve 45. Consequently, when an attachment heavier than usual is attached or when a heavy load is suspended, stoppability can be ensured.

The other control processes which are not described here are performed in the same way as in Example 1 and description thereof is omitted.

As described so far, this embodiment brings about the following advantageous effects.

(1) In this embodiment, a construction machine such as a hydraulic excavator 1 with a front mechanism (boom 31, arm 33, bucket 35, work attachment) including an arm 33 driven by a hydraulic actuator 43 through manipulation of an operating lever 50 as an operating device includes: a posture sensor which detects the posture of the arm 33; and a control valve 42, pump torque control solenoid valve 45, pump regulator 46, and controller 49 as control devices which, when the posture of the arm 33 is at a remoter side from an upperstructure 20 as a construction machine main body than a preset position and the position of the work attachment at the arm tip, for example, the bucket 35, is adjusted from a maximum (full lever) or nearly maximum preset operation amount (pilot pressure PB) of the operating lever 50 in arm pushing operation by the operating lever 50, change the flow rate characteristic of pressure oil in relation to discharge pressure of a hydraulic pump 41 for supplying pressure oil to the hydraulic actuator 43, to characteristic PTS with a higher flow rate than the flow rate characteristic PT at the time of operation with a operation amount other than the above operation amount, to drive the hydraulic pump 41.

According to this structure, in the case that the arm 33 is operated toward the remoter side than the upperstructure 20 and the posture of the arm 33 is remoter than a preset position, when making the above position adjustment or performing stopping operation from the maximum or nearly maximum preset operation amount as the operation amount of the operating lever 50 in arm pushing operation by the operating lever 50, the flow rate characteristic of pressure oil in relation to the discharge pressure of the hydraulic pump 41 for supplying pressure oil to the hydraulic actuator 43 is changed to the characteristic PTS with a higher flow rate than the flow rate characteristic PT at the time of operation with a operation amount other than the above operation amount to drive the hydraulic pump 41, so the speed decrease amount of the arm 33 in relation to the decrease amount of the operating lever 50 can be made constant and behavior as imagined by the operator can be ensured, resulting in improvement in the operability in arm pushing operation.

(2) In this embodiment, the posture sensor includes first and second angle sensors 37 and 38 as angle sensors which detect the angle of the front mechanism including the arm 33, and the controller 49 as a control device detects the posture of the arm 33 according to detection outputs of the first and second angle sensors 37 and 38.

According to this structure, the posture of the front mechanism can be easily detected from the detection outputs of the first and second angle sensors 37 and 38.

(3) In this embodiment, the posture sensor includes a boom stroke sensor 32*a* and an arm stroke sensor 34*a* as stroke sensors which detect the stroke when the hydraulic actuator 43 drives the front mechanism, and the controller 49 as a control device detects the posture of the arm according to detection outputs of the boom stroke sensor 32*a* and arm stroke sensor 34*a*.

According to this structure, the posture of the front mechanism can be easily detected from the detection outputs of the boom stroke sensor 32*a* and arm stroke sensor 34*a*.

(4) In this embodiment, the front mechanism includes a boom 31 with the arm 33 at a tip, and the control device includes: a third pressure sensor 53*c* as a bottom pressure sensor which detects the bottom pressure of the hydraulic actuator 43 (boom cylinder 32) for driving the boom 31; a third characteristic (table) 63 as a flow rate characteristic correction device which corrects the above flow rate characteristic according to the bottom pressure detected by the third pressure sensor 53*c*; and a controller 49.

According to this structure, flow rate increase control in arm pushing operation can be performed in consideration of the position of the boom 31, so the operability in arm pushing operation can be further improved depending on the position of the boom 31.

(5) In this embodiment, the preset position is set at the A position where the arm 33 is vertical to the ground 65.

According to this structure, control is performed on the basis of the A position which is easily detected, so the operability in arm pushing operation can be improved by a simple control structure.

The present invention is not limited to the above embodiment and various modifications can be made without departing from the gist of the invention, and all technical matters included in the technical idea described in the claims are covered by the present invention. The above embodiment is a preferred example but those skilled in the art can make various alternatives, modifications, variations or improvements in the light of what is disclosed in this specification and these fall within the technical scope described in the appended claims.

REFERENCE SIGNS LIST

1 . . . hydraulic excavator (construction machine),
20 . . . upperstructure (construction machine main body),
31 . . . boom (front mechanism),
32 . . . boom cylinder,
32*a* . . . boom stroke sensor (stroke sensor),
33 . . . arm (front mechanism),
34*a* . . . arm stroke sensor (stroke sensor),
35 . . . bucket (front mechanism),
37 . . . first angle sensor (angle sensor),
38 . . . second angle sensor (angle sensor),
41 . . . hydraulic pump,
42 . . . control valve (control device),
43 . . . hydraulic actuator,
45 . . . pump torque control solenoid valve (control device),
46 . . . pump regulator (control device),
49 . . . controller (control device),
50 . . . operating lever (operating device),
53*a*, 53*b* . . . first and second pressure sensors (operation amount sensors),
53*c* . . . third pressure sensor,
63 . . . third characteristic

The invention claimed is:

1. A construction machine comprising:
an engine;
a hydraulic pump driven by the engine;
an arm cylinder driven by pressure oil discharged from the hydraulic pump;
an arm operated by extension and shrinkage of the arm cylinder;
a front mechanism including the arm and a work attachment attached to a tip of the arm;
an operating device for operating the arm; and a control device for controlling a flow rate of the hydraulic pump based on an operation amount of operation by the operating device, wherein the construction machine includes:

a posture sensor for detecting a posture of the arm; and a operation amount sensor for detecting the operation amount of the operating device, in case that the control device decides that the posture of the arm detected by the posture sensor has changed to a posture in a remoter position from a main body of the construction machine than a vertical position with respect to a ground, and that the operation amount detected by the operation amount sensor has changed from a maximum or nearly maximum preset operation amount to an operation amount toward a fine manipulation direction for positioning of the work attachment, the control device changes a flow rate characteristic of pressure oil in relation to discharge pressure of the hydraulic pump to a characteristic with a higher flow rate than a flow rate characteristic at time of operation with an operation amount other than the operation amount detected by the operation amount sensor, to drive the hydraulic pump.

2. The construction machine according to claim 1, wherein the posture sensor includes an angle sensor for detecting an angle of the front mechanism including the arm, and the control device detects the posture of the arm based on detection output of the angle sensor.

3. The construction machine according to claim 1, wherein the posture sensor includes a stroke sensor for detecting a stroke when the front mechanism is driven, and the control device detects the posture of the arm based on detection output of the stroke sensor.

4. The construction machine according to claim 1, wherein the front mechanism includes a boom which has the arm at a tip, and the control device includes: a bottom pressure sensor for detecting a bottom pressure of a hydraulic actuator for driving the boom; and a flow rate characteristic correction device for correcting the flow rate characteristic based on the pressure detected by the bottom pressure sensor.

* * * * *